US010494152B2

(12) United States Patent
Ramsey

(10) Patent No.: US 10,494,152 B2
(45) Date of Patent: Dec. 3, 2019

(54) RE-CLOSABLE CONTAINER

(71) Applicant: CROWN PACKAGING TECHNOLOGY, INC., Alsip, IL (US)

(72) Inventor: Christopher Paul Ramsey, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 15/566,435

(22) PCT Filed: Apr. 12, 2016

(86) PCT No.: PCT/EP2016/058036
§ 371 (c)(1),
(2) Date: Oct. 13, 2017

(87) PCT Pub. No.: WO2016/166112
PCT Pub. Date: Oct. 20, 2016

(65) Prior Publication Data

US 2018/0134460 A1 May 17, 2018

(30) Foreign Application Priority Data

Apr. 13, 2015 (GB) ..... 1506232.6

(51) Int. Cl.
*B65D 41/04* (2006.01)
*B65D 51/16* (2006.01)
(Continued)

(52) U.S. Cl.
CPC ..... *B65D 41/0428* (2013.01); *B65B 3/04* (2013.01); *B65B 7/2835* (2013.01); *B65D 41/0442* (2013.01); *B65D 51/1688* (2013.01)

(58) Field of Classification Search
CPC ..... B65D 41/0428; B65D 51/16; B65D 41/0457; B65D 51/145
See application file for complete search history.

(56) References Cited

U.S. PATENT DOCUMENTS 3,270,904 A 9/1966 Foster et al.
3,344,943 A 10/1967 Zipper
(Continued)

FOREIGN PATENT DOCUMENTS

DE 9421425 U1 12/1995
EP 2662296 A1 11/2013
(Continued)

*Primary Examiner* — Shawn M Braden
(74) *Attorney, Agent, or Firm* — BakerHostetler

(57) ABSTRACT

A re-closable container comprising a container body (12), a single piece metal closure and a layer of sealing compound provided on an underside of the closure. The container body and the closure have first cooperating features (14) to allow the closure to be twisted onto and off of the container body. The layer of sealing compound and a sealing surface (18) of the container body which comes into contact with the sealing compound have second cooperating features (40) which establish one or more venting passages upon rotation of the closure from a closed position. The second cooperating features comprise one or more protrusions or indents in the sealing surface and one or more corresponding indents or protrusions on the sealing compound that are radially aligned with the one or more protrusions or indents in the sealing surface when the closure is in a closed position.

11 Claims, 10 Drawing Sheets

(51) Int. Cl.
*B65B 3/04* (2006.01)
*B65B 7/28* (2006.01)

(56) References Cited

U.S. PATENT DOCUMENTS

| | | | | | |
|---|---|---|---|---|---|
| 3,730,370 | A * | 5/1973 | Lecinski | B65D 41/06 | 215/221 |
| 3,741,423 | A * | 6/1973 | Acton | B65D 41/0457 | 215/318 |
| 4,392,580 | A * | 7/1983 | Ochs | B21D 51/44 | 215/332 |
| 4,603,786 | A | 8/1986 | Lecinski, Jr. et al. | | |
| 5,135,124 | A | 8/1992 | Wobser | | |
| 5,740,914 | A * | 4/1998 | Herzog | B65D 21/0219 | 206/501 |
| 5,746,337 | A | 5/1998 | Haist | | |
| 6,227,391 | B1 | 5/2001 | King | | |
| 6,234,338 | B1 | 5/2001 | Searle | | |
| 7,861,874 | B2 | 1/2011 | Cook et al. | | |
| 9,637,269 | B1 * | 5/2017 | Zabaleta | B65D 47/243 | |
| 2005/0224498 | A1 | 10/2005 | Savicki | | |
| 2013/0248530 | A1 | 9/2013 | Rouquette et al. | | |
| 2014/0263155 | A1 * | 9/2014 | Szczesniak | B65D 41/385 | 215/252 |
| 2014/0263321 | A1 | 9/2014 | Chisholm | | |

FOREIGN PATENT DOCUMENTS

| | | | |
|---|---|---|---|
| EP | 3045434 | A1 | 7/2016 |
| GB | 1411127 | A | 10/1975 |
| WO | WO 2004/002844 | A1 | 1/2004 |
| WO | WO 2010/136414 | A1 | 12/2010 |

* cited by examiner

RE-CLOSABLE CONTAINER

CROSS-REFERENCE TO RELATED APPLICATIONS

This application is the National Stage of International Application No. PCT/EP2016/058036, filed Apr. 12, 2016, which claims the benefit of GB application number 1506232.6, filed Apr. 13, 2015, the disclosures of which are incorporated herein by reference in their entirety.

TECHNICAL FIELD

The present invention relates to re-closable containers such as, for example, glass jars with metal closures. More particularly, the invention relates to re-closable containers which are packed such that a partial vacuum exists within the packed container prior to first opening.

BACKGROUND

It is well-known for foodstuffs and beverages, such as preserves, pickles, baby food, fruit juice and the like, to be supplied in vacuum-sealed containers, in order to extend the shelf-life of the product. Typically, a partial vacuum is formed in the space, known as the headspace, between the surface of the product and the closure, or lid, of the container, during the filling and capping process. For example, the partial vacuum in a 70 mm diameter container may be between 18 and 24 inches of mercury (from 0.61 to 0.81 bar).

The internal diameter of jars vary in size due to the manufacturing process. Taking the smallest possible jar diameter and lowest vacuum gives a lower vacuum load of 175N (Newtons). Taking the largest possible jar diameter and highest vacuum gives an upper vacuum load of 240N. Hence, the strength requirement of each lug is at least 60N.

The majority of vacuum-sealed containers are threaded, the associated closure having lugs designed to co-operate with the thread, so that the closure can be twisted off the container during opening. Opening requires that two forces be overcome, namely that caused by the partial vacuum and that caused by friction between the screw threads. Typically, a soft sealing compound is applied around the underside of the closure to help maintain a tight seal between the container body and the closure.

For a 70 mm diameter container, the typical torque required to overcome the force of the vacuum seal is around 25 inch pounds (inlbs), while the torque required to overcome the frictional force of the screw thread is around 12 inch pounds (inlbs). It can therefore be difficult to open vacuum-sealed containers, particularly for consumers who are unable to apply the necessary force, such as the elderly. A study carried out in the UK showed that 33% of women over 55 are unable to open 50% of jars that they purchase due to the excessive torque.

A consequential problem with threaded containers is that the lugs of the closure may not be strong enough to cope with the torque required to open the container and may be bent in the process. This may cause the closure to simply spin, rather than unscrewing. The tendency for "spinners" to occur is accentuated by several factors, one being the "earing" of the steel. When a "spinner" occurs, the panel of the closure is not lifted, and the vacuum seal may remain intact. This can result in the container becoming impossible to open. Furthermore, even if the vacuum seal is broken, it may not be possible to reclose the container due to the deformation of the lugs. "Spinning" leads to customer dissatisfaction and potential wastage. Increased lug strength is often viewed as a solution to the problem of "spinning". However, this can result in increased manufacturing costs due to increased use of metal.

For example, capping trials have been carried out on a high speed in-line capping machine. For this, 70 mm deep closures were manufactured with 4 lugs in a range of thicknesses. The vacuum was set to the top of the process window and glass jars were selected with the minimum diametral tolerance, thus they were as small as possible. The glass jar finish varies considerably in size due to the manufacturing process, a typical tolerance being +/−0.4 mm on diameter in the thread region.

For 0.17 mm thick steel closures the 'spinning' failure rate was measured at around 2.5%. When the gauge was increased to 0.18 mm the trials gave a 0.5% failure rate. Using a gauge of 0.19 mm and harder temper steel gave a 0% failure rate. The "spinner" issue was therefore solved but at the expense of producing thicker closures in a non-standard temper.

Easy close containers are known in the prior art. In particular, vacuum-sealed containers provided with venting features, such as channels or notches, are known. EP2662296A1 discloses a non-threaded, vacuum-sealed container which is provided with a venting feature on the container rim, while U.S. Pat. No. 7,861,874B2 discloses a threaded, re-closeable container having a lug configuration which includes a controlled venting path.

SUMMARY OF THE INVENTION

According to a first aspect of the present invention there is provided a re-closable container comprising a container body, a single piece metal closure and a layer of sealing compound provided on an underside of the closure. The container body and the closure have first cooperating features to allow the closure to be twisted onto and off of the container body. The layer of sealing compound and a sealing surface of the container body which comes into contact with the sealing compound have second cooperating features which establish one or more venting passages upon rotation of the closure from a closed position. The second cooperating features comprise one or more protrusions or indents in the sealing surface and one or more corresponding indents or protrusions on the sealing compound that are radially aligned with the one or more protrusions or indents in the sealing surface when the closure is in a closed position As an option the first cooperating features comprise a thread on a neck region of the container and lugs provided on an inner surface of the closure.

The lugs may be configured to jump over the thread when the closure is twisted while the container body is venting.

The lugs may be sufficiently elastically deformable to facilitate said jumping.

The second cooperating features may comprise three or more protrusions on the sealing surface and associated indents in the sealing compound.

The second cooperating features may comprise three or more indents on the sealing surface and associated protrusions on the sealing compound.

The sealing surface may be an upper surface of a rim of the container.

The thread may have an asymmetric profile.

The thread may be continuous or dis-continuous.

The sealing compound may be plastisol.

The container may contain a product and a partial vacuum existing with a headspace of the product.

According to a second aspect of the present invention there is provided a method of combining a container body and a single piece closure to form the re-closable container of the first aspect. The method comprises filling the container body with a hot product, applying a soft sealing compound to an underside of the closure, screwing the closure onto the container body, and allowing the sealing compound to harden.

According to a further aspect of the present invention there is provided a re-closable container comprising a container body and a single piece closure. The container body and the closure have first cooperating features to allow the closure to be twisted onto and off of the container body. A sealing surface of the container body and an underside of the closure that is provided with a sealing compound have second cooperating features which establish one or more venting passages upon rotation of the closure from a closed position.

DETAILED DESCRIPTION

Figure 1:
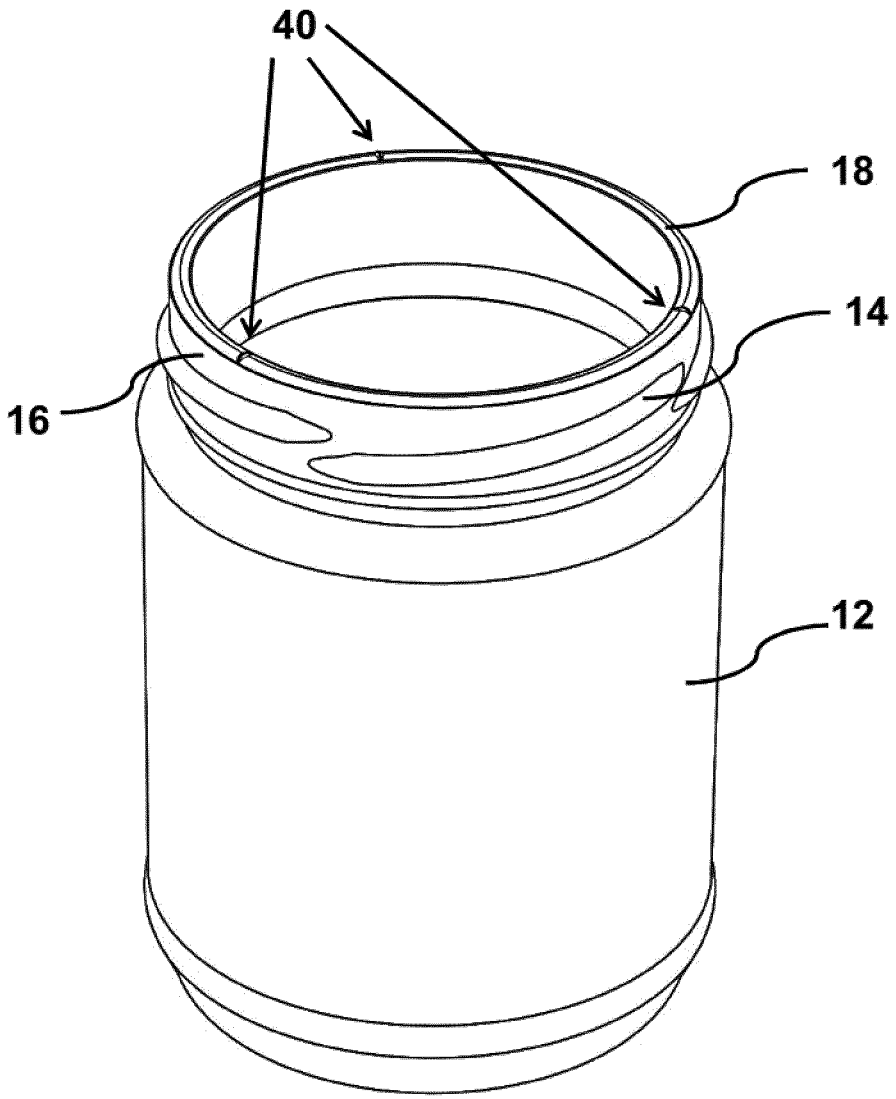
FIG. 1 is a perspective view of a threaded container body provided with venting features.

FIG. 1 is a perspective view of a threaded container body 12 provided with venting features 40, and shown without a closure. The container body 12 may be utilised for foodstuffs and beverages, such as preserves, pickles, spreads, baby food, fruit juice etc. Alternatively, the container body 12 may be used for other substances or liquids.

The container body 12 in this illustrated example is glass. The container body 12 comprises a neck 16, which defines a non-continuous thread 14, or series of discrete overlapping and inclined ridges, on its outer surface. The container body neck 16 terminates in a sealing surface 18, or rim, which forms a seal with the single-piece closure, when the container body 12 is closed. The sealing surface 18 in this example is provided with three venting features 40, which comprise generally sloping discrete protrusions forming discontinuities on the sealing surface 18 of the neck 16.

Figure 2:
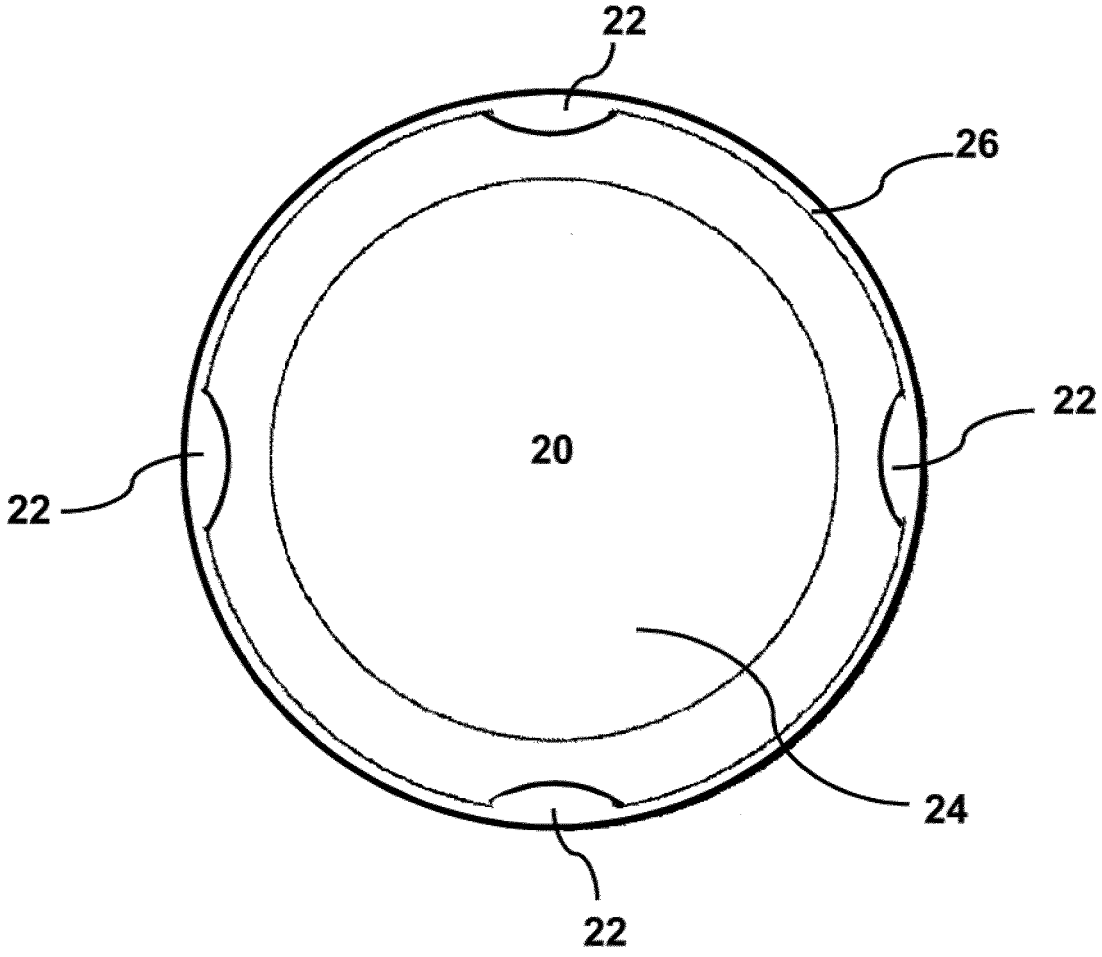
FIG. 2 is a plan view of the underside of a twist-off closure for use with the container of FIG. 1.

FIG. 2 is a plan view of a twist-off, single-piece closure 20, or lid, for use with the container body 12 of FIG. 1. The closure in this example is a metal closure although it may be made from any suitable material, e.g. plastics. In this example, both the closure 20 and the container body 12 are generally cylindrical. The closure 20 comprises a panel 24 and a wall 26 depending from the panel 24. The wall 26 is provided with lugs 22 on an internal surface, which are configured to co-operate with the container body thread 14 in order to remove or replace the closure 20 from the container body 12. In this example, four substantially identical lugs 22 are provided.

During the manufacturing process, not shown here, a layer of sealing compound, such as a plastisol, will be applied to the interior of the closure 20 shown in FIG. 2. The sealing compound softens due to superheated steam being applied in the capping chute, so that it is soft when first applied and when the closure is first applied to the container, and will mould itself to the profile of the sealing surface 18 including the venting features 40, forming a tight seal. The container body 12, once filled, is capped with a closure 20 and a partial vacuum is created, sealing the container.

In order to open the container once it has been sealed, it is necessary to twist off the closure 20 by applying sufficient torque to overcome a combination of the frictional forces between the closure lugs 22, container body thread 14 and sealing compound (not shown here), and the force of the vacuum seal. Beneficially, the closure 20 may be screwed back on to protect the container body 12 contents. However, the original vacuum seal, once broken, cannot be reinstated.

As regards the container body 12 and closure 20 shown in FIGS. 1 and 2, it will be understood that, as the closure 20 begins to be twisted off the container body 12, the discrete recesses which were formed as discontinuities in the sealing compound during the filling/capping process by the venting features 40 move away from their original position, creating leakage paths in the sealing compound, and allowing air to enter the container body 12, breaking the vacuum seal. Thus, the vacuum seal is broken during rotation of the closure, e.g. less than 180 degrees. The venting is gradual so that the actual angular rotation over which the vacuum is released will vary due to the level and volume of headspace, size of jar, number and size of the venting features plus the speed that the consumer is opening the jar. Thus the venting may occur before or after contact of the lugs 22 with the threads 14.

Following the breaking of the vacuum seal, continued rotation of the closure will cause the lugs 22 to move along the next available thread 14 formed on the neck of the container. The removal of the axially directed force exerted by the pressure seal means that the only remaining force resisting rotation is the friction between the lugs 22 and the thread 14. As this friction force is relatively small, the further rotation of the closure is unlikely to deform even relatively lightweight lugs, with the lugs therefore retaining their shape following full removal of the closure. The likelihood of "spinning" at this stage is reduced or eliminated. Once removed, the closure 20 can be screwed back onto the container body 12 to reseal the container.

This approach allows for "light-weighting" or weakening of the lugs 22 and a consequential reduction in manufacturing costs and environmental impact, since less material is used.

However, the retention of closure lugs 22 and the cooperating thread 14 are beneficial in order to retain the closure 20 on the container body 12 after the vacuum seal has been broken, and also to retain the closure 20 during the capping process, while the vacuum seal is still forming. The lugs 22 are also useful in reducing the risk of the vacuum seal being lost as a result of impact damage during processing or distribution.

Figure 3:
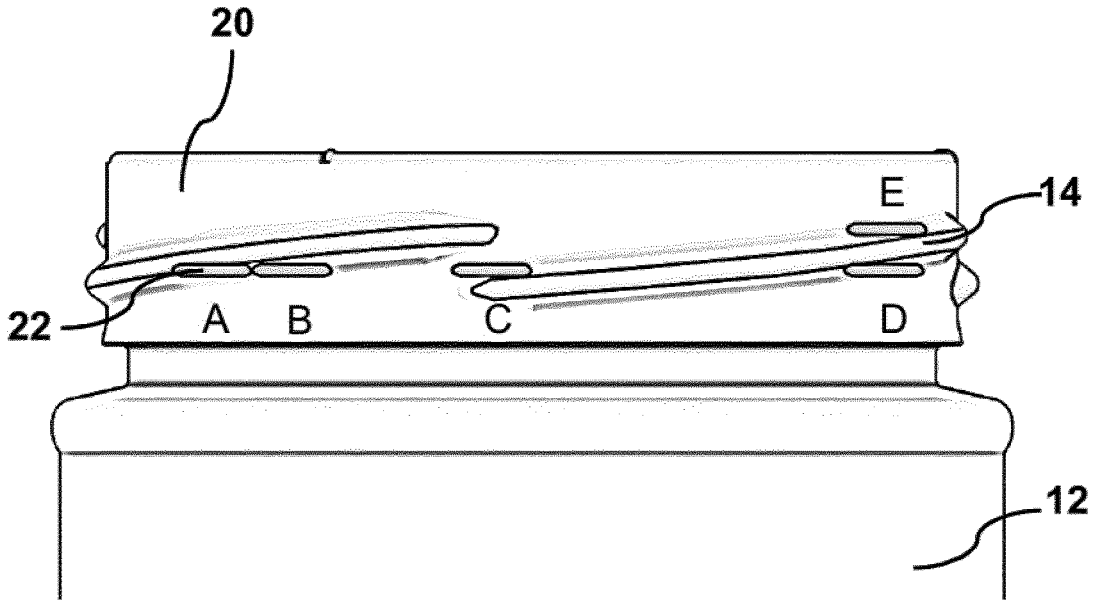
FIG. 3 is a diagrammatic view of the container body of FIG. 1 and closure of FIG. 2.

FIG. 3 is a diagrammatic view of the container body 12 of FIG. 1 and closure 20 of FIG. 2, showing the progression of the lugs 22 during rotation of the closure 20 in more detail. The lugs 22 progress between a lug release position A and a position E in which the lug 22 has risen up the thread 14.

During the opening of conventional glass jars there are two main events; the 'lug release' from under the threads, and the 'lug engagement' event when the lugs have rotated and contacted the next thread, causing the panel to lift.

Lug 'security' is defined as the circumferential distance, from the angular position to which the lug is initially tightened on capping, to the angular position where the cap becomes free of load from the thread during opening. The 'security' is thus a measure of how much the closure can 'back off' before losing tightness. Security is one of the key quality measurements taken on the capping line and protects against accidental opening of the jar, for example, due to an impact. A typical 'security' specification for a 70 mm diameter closure would be 8 mm.

In FIG. 3, the following positions are indicated by references A to E: A—Lug release; B—Lug with no 'security'; C—Lug engagement; D—Lug jumped over thread and E—Lug risen up thread.

In the 'lug release' event the torque primarily arises from two factors; static friction between the sealing compound and sealing surface, plus static friction between the lug and threads. In the 'lug engagement' event the torque primarily arises from two factors; sliding friction between the compound and sealing surface, plus sliding friction between the lug and threads. Since the static coefficient of friction is significantly higher than for sliding the most difficult operation for the consumer is the initial 'lug release' event. For conventional closures and jars the vacuum seal is only broken when the closure is turned and the lugs contact the threads with sufficient force to lift the closure upwards.

In contrast, the closure 20 used with the glass container body 12 that includes venting features (not shown here) does not rise vertically until the seal is broken and the vacuum is at least partially released.

Counter-intuitively it has therefore been found possible to reduce the opening torque by weakening the lugs. This is because for a given 'security' level, the static friction due to the lug load reduces with the lug strength. The effect can be considerable, for example reducing the load by several inlbs. For a 70 mm jar a typical torque from the vacuum would be around 25 inlbs compared to the torque from the lugs of around 12 inlbs. A weakened lug reduces the torque required to move from position A to position B, for example.

In the example shown in FIG. 2, the weakened or "light-weighted" lugs 22 have an axial lug strength of less than 50N, whereas conventional lugs have a strength of at least 60N. Axial strength is defined as the force that the lug imparts on the closure before spinning when used with a conventional glass jar finish. The thickness of the lug 22 material is at least 10% thinner than for a conventional closure. The contribution to the initial opening torque, after processing, from lug 22 to glass friction is less than 20% of the total torque (conventional torques from the lug friction are around 30% of the total torque).

Since venting may occur before or after contact of the lugs 22 with the thread 14, a benefit of weakening the lugs 22 is to increase their elasticity so that they are able to jump the thread 14 (as shown in position D of FIG. 3) if required during rotation of the closure 20 without being damaged or suffering permanent deformation. The lugs 22 remain functional and provide at least 80% of the initial retention force. This permits rotation of the closure 20 and venting of the vacuum seal to continue without lifting of the closure panel (not shown here). As discussed, the closure panel will not rise vertically until the seal is broken and the vacuum at least partially released.

Venting may still be in progress when the lugs 22 reach position C of FIG. 3, for example. If this is the case, the lugs 22 are configured to be sufficiently flexible or elastic to be able to jump over the thread 14 into position D, without suffering permanent deformation. The lugs 22 will not move into position E (typically on the next thread portion) until venting is at least partially complete.

The venting features (not shown here) on the glass finish or sealing surface 18 are an aid to the jar security because they make it more difficult for the closure 20 to 'back off' accidentally.

Figure 4:
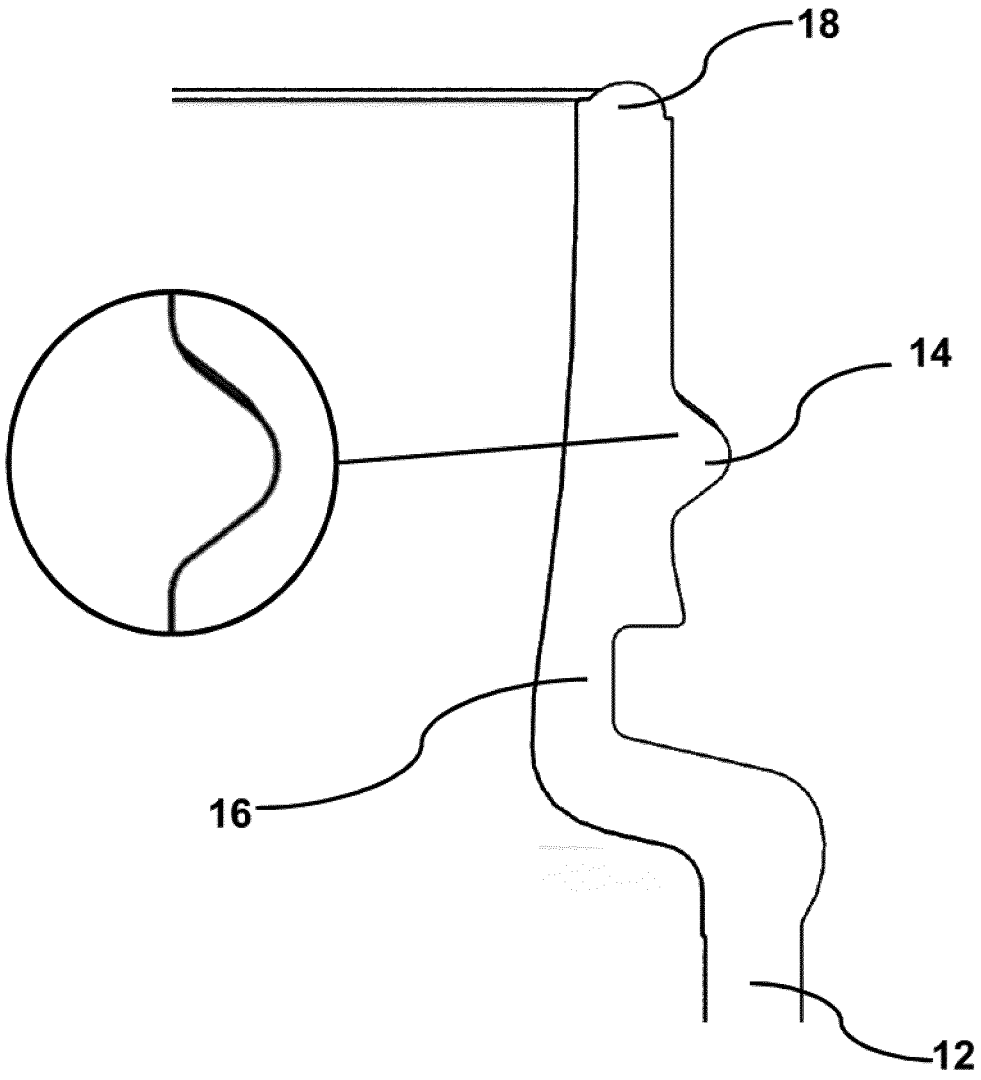
FIG. 4 is an axial cross sectional view of a neck region of the container body of FIG. 1, and including a call-out of the container thread.

FIG. 4 is a cross sectional view of the thread 14 of the glass container body 12 of FIG. 1. The non-continuous container thread 14 comprises a series of discrete, overlapping ridges, configured to co-operate with the closure lugs 22 to allow the closure 20 to be unscrewed from or screwed back onto the container body 12. As shown in the enlargement (illustrating the container thread profile), the thread 14 has a substantially symmetrical cross section in the axial direction.

Figure 5:
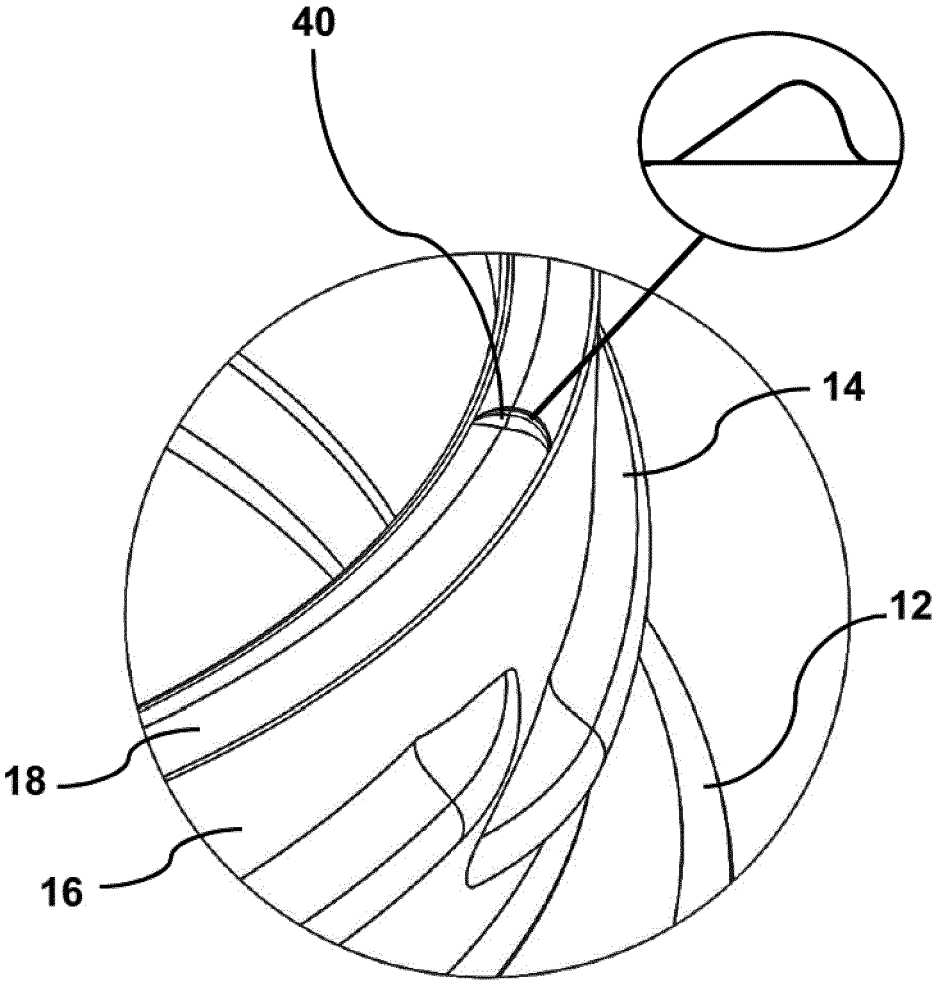
FIG. 5 is a detail of the container body of FIG. 1 showing a venting feature, and including a call-out of the venting feature.

FIG. 5 is an enlarged view of a localised venting feature 40 on the container body 12 of FIG. 1. In this illustrated example, one of the discrete venting features 40 is shown on the sealing surface 18, or rim, of the container body neck 16. As shown in the enlargement (illustrating the radially extending profile of the feature), the venting feature 40 in this example comprises a sloping protrusion, extending radially across the sealing surface 18. The protrusion is integrally formed with the sealing surface 18 and is raised approximately 0.2 mm above the sealing surface 18 at its highest point. The container body 12 shown in FIG. 1, FIG. 3, FIG. 4 and FIG. 5 is provided with three discrete protruding venting features 40, as this ensures that the vacuum seal is broken quickly. However, the venting features 40 are not sufficiently large so as to interfere with the opening of the container, or to increase the torque required to open the container.

As previously discussed, while the layer of sealing compound (not shown here) is soft it moulds itself to the profile of the sloping protrusions, creating corresponding recesses within the sealing compound, which subsequently harden to become permanent. When the container body 12 is to be opened, a rotation of the closure 20 relative to the sealing surface 18 causes the recesses to move from their original positions, creating multiple leakage paths and venting the container body 12.

Figure 6:
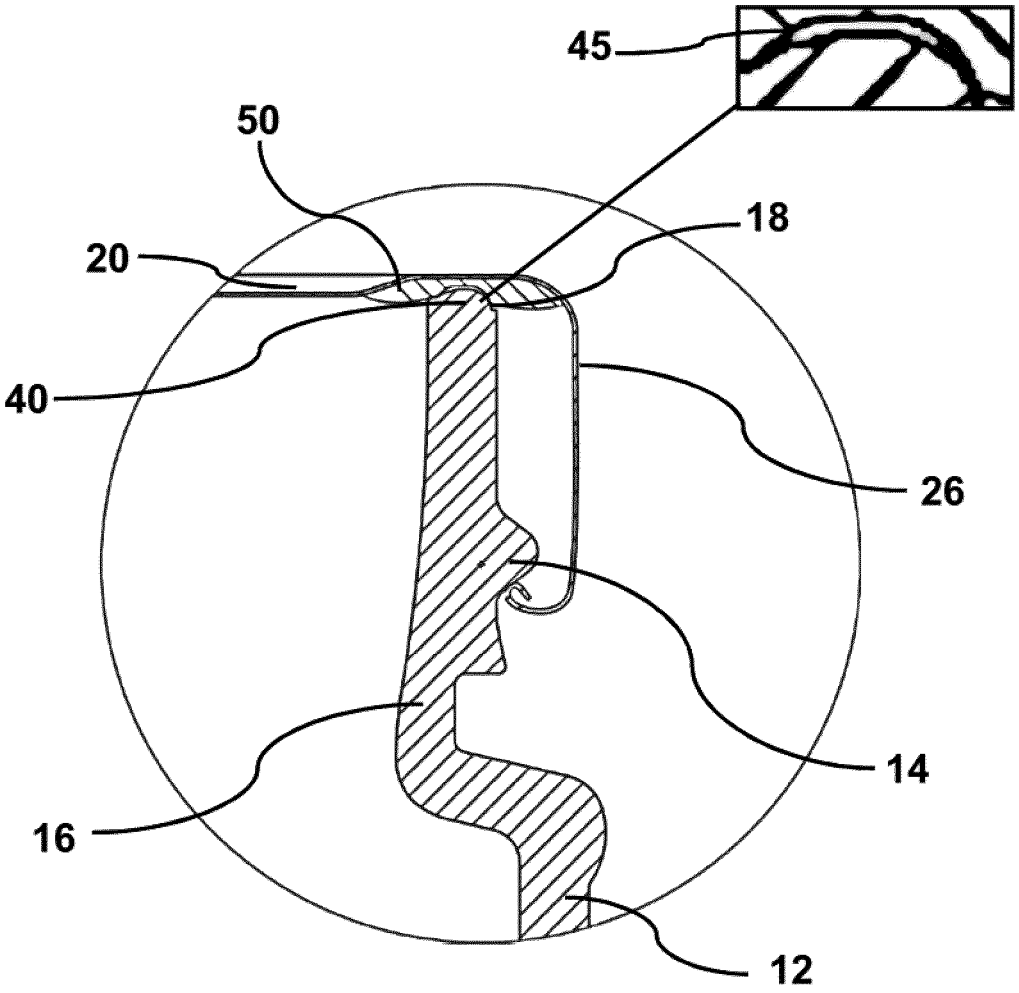
FIG. 6 is an axial cross sectional view of the venting feature of the container body and closure of FIGS. 1 and 2, and including a call-out of the venting feature.

FIG. 6 is an axial cross sectional view of the neck 16 region of the container body 12 with the closure 20 in place, taken through one of the venting features 40 (according to the embodiment of FIGS. 1, 2, 3, 4 and 5). The enlargement, which illustrates the venting feature 40, shows the corresponding recess 45 formed in the sealing compound 50.

Figure 7:
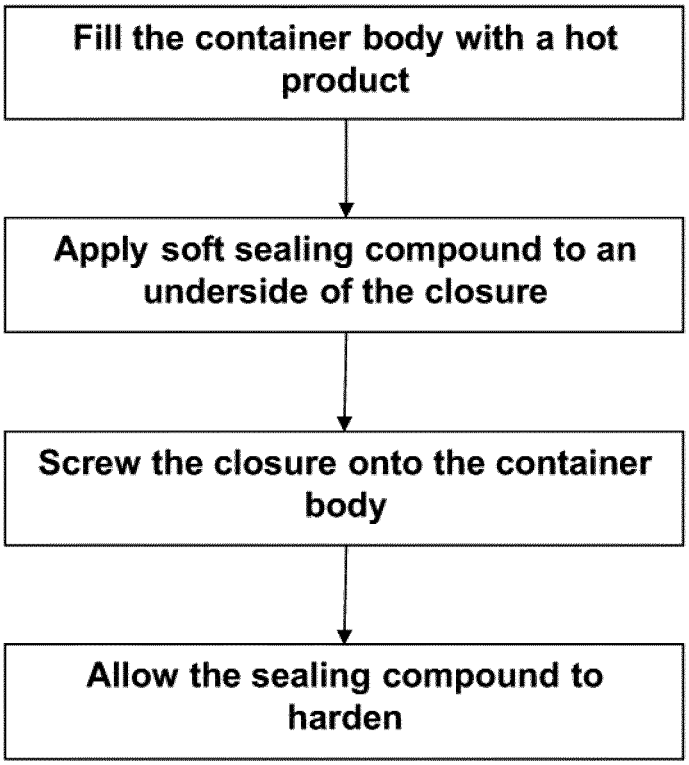
FIG. 7 is a flow diagram representing a method of combining the container body of FIG. 1 and the closure of FIG. 2 to form a re-closable container.

FIG. 7 is a flow diagram representing a method of combining the container body 12 of FIG. 1 and the single piece closure 20 of FIG. 2 to form a re-closable container.

The method comprises filling the container body 12 with a hot product, applying soft sealing compound 50 to an underside of the closure 20, screwing the closure 20 onto the container body 12, and allowing the sealing compound 50 to harden. As the layer of sealing compound 50 is soft it moulds itself to the profile of the sloping protrusions, creating corresponding recesses within the sealing compound 50, which subsequently harden to become permanent.

Figure 8:
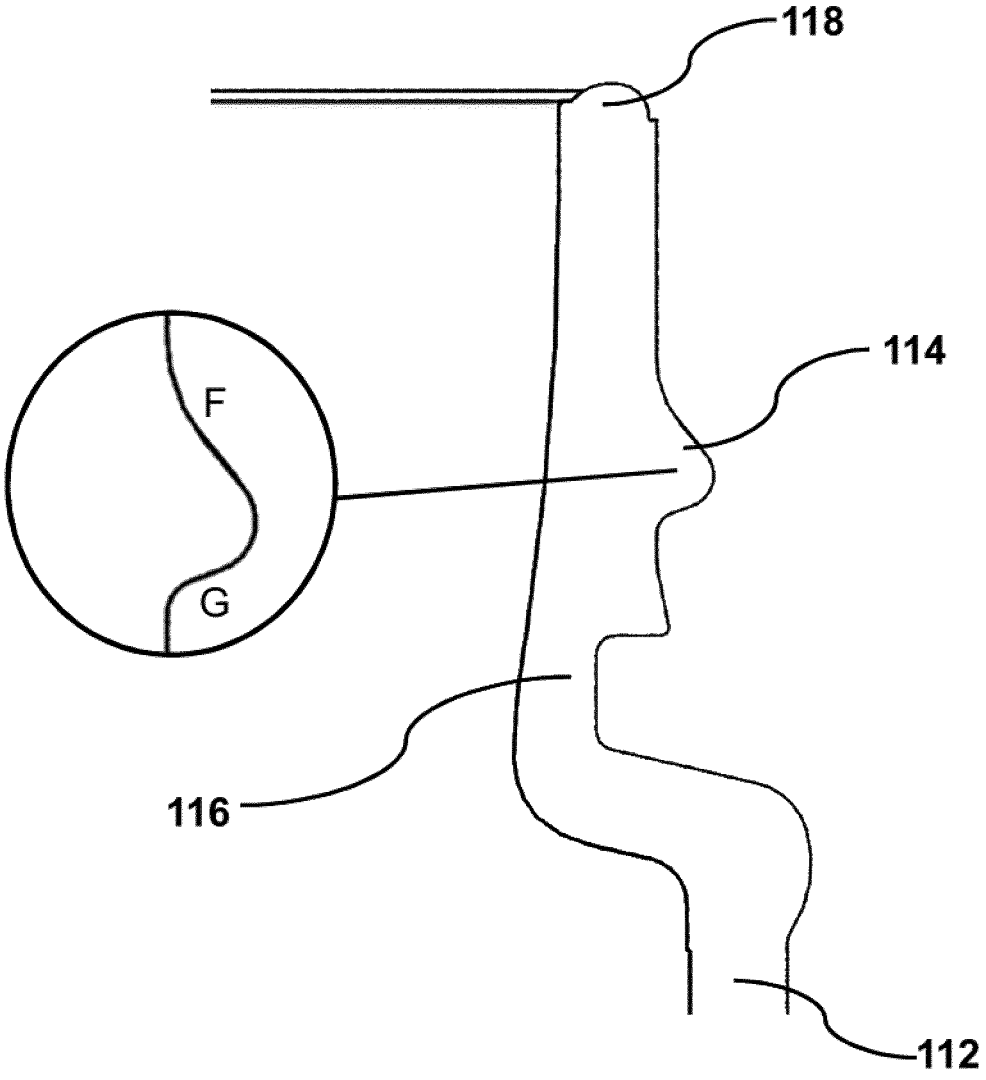
FIG. 8 is an axial cross sectional view of a neck region of an alternative container having an asymmetric thread arrangement, and including a call-out of the container thread.

FIG. 8 is a cross-sectional view of an alternate thread 114 arrangement. As shown in the enlargement (illustrating the container thread profile), the upper thread angle is large, e.g. 50 degrees, and the lower thread angle is smaller, e.g. 20 degrees. The asymmetric thread profile 114 shown in FIG. 8 enables the closure lugs 22 to jump over the thread 114 more easily when the lugs 22 are in position F, i.e. on top of the thread 114. The lugs 22 are less able to jump over the asymmetric thread 114 when they are in position G i.e. underneath the thread. The thread profile 114 has good retention force when being applied but "spins" more easily when being removed. The lugs 22 create a greater downward than upward force on the closure for a given torque. Thread asymmetry reduces the torque required to overcome the frictional force between the closure lugs 22, 222 and the container body thread 114 and makes the container body 112 easier to open. The asymmetric thread profile 114 is also beneficial during the capping process, where it may be difficult to configure capping equipment to a low torque setting.

Figure 9:
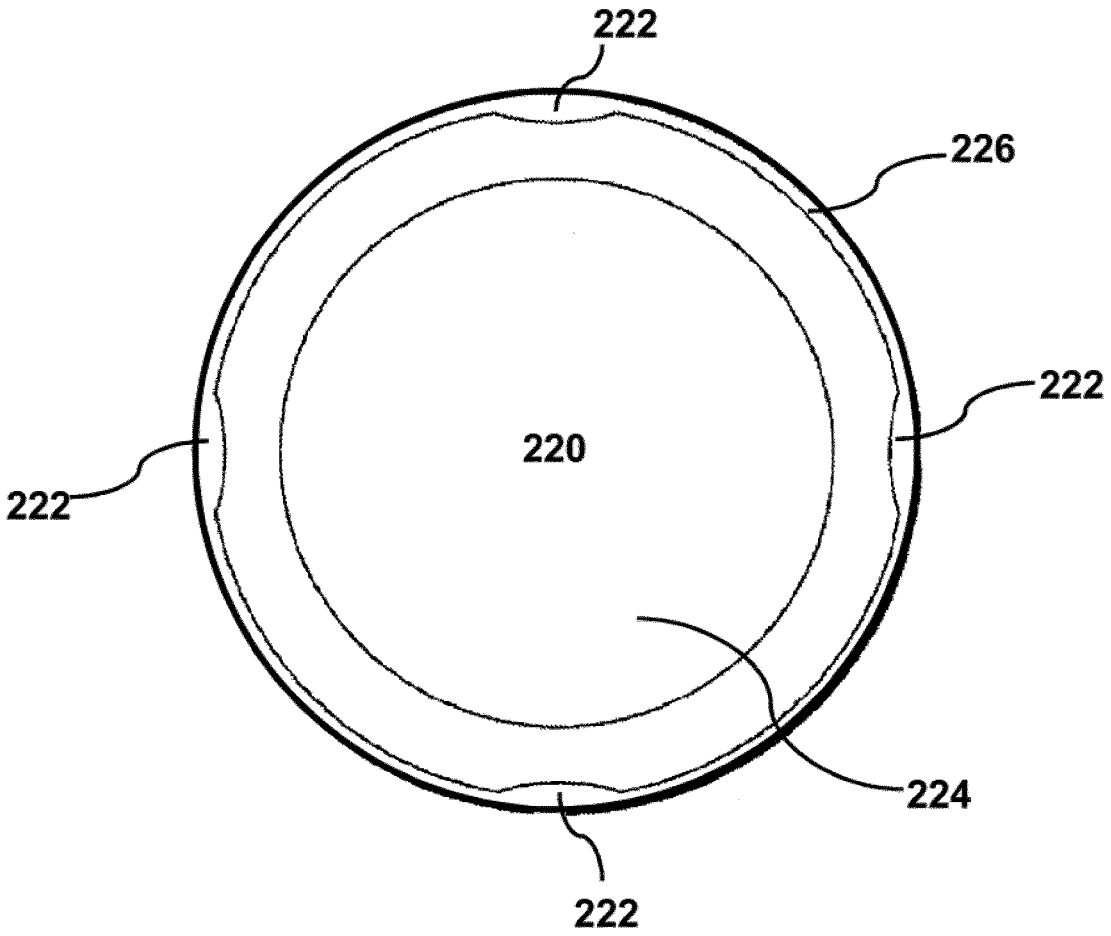
FIG. 9 is a plan view of the underside of an alternate twist-off closure.

FIG. 9 is a plan view of an alternate twist-off closure 220, provided with four substantially identical lugs 222. These lugs 222 have a reduced radial extent in comparison with the lugs 22 shown in FIG. 2 and it is the reduction in radial extent, rather than in their thickness or gauge, that reduces the lug strength in this example. It will be understood that lugs 222 of reduced radial extent require less material and therefore cost less to manufacture. As such, it will be appreciated that the term "light-weighting" refers to a reduced material thickness and reduced extent, as well as to a combination of both. It might also refer to a reduction in the number of lugs, e.g. from four to three.

As previously discussed, "light-weighting" or weakening of the closure lugs 22, 222 also reduces the torque necessary to overcome the frictional force between the lugs 22, 222 and the container body thread 14, 114 and therefore the force required to unscrew the closure 20, 220 from the container body 12, 112, 312. This is because "light-weighted" lugs 22, 222 typically result in lower friction between the lugs 22, 222 and the container body thread 14, 114. An additional benefit of reducing the overall lug strength is therefore to make the closure 20, 220 easier to remove from the container body 12, 112, 312 once the vacuum seal has been broken.

Figure 10:
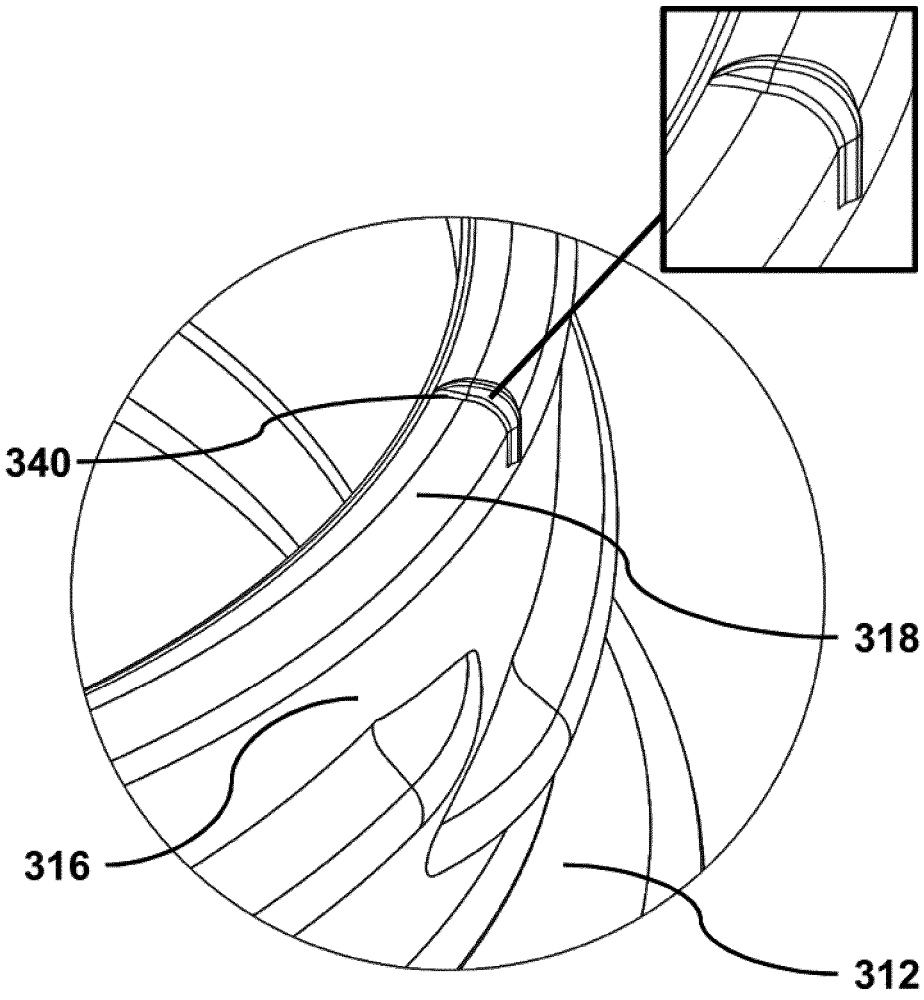
FIG. 10 is a perspective view of a further alternative container provided with an alternate venting feature arrangement, and including a call-out of the venting feature.

FIG. 10 is a perspective view of an alternate venting feature arrangement, in which the discrete venting feature 340 comprises a sloping protrusion, shown in the enlargement, which runs around the sealing surface 318 to where the sealing surface 318 meets the container body neck 316. This alternate arrangement is beneficial in that a leakage path is created that runs all the way around the edge of the sealing surface 318. This arrangement may result in a sharper edge to the container body neck 316, which may be less desirable where the container body 312 is intended to be drunk from, once opened.

It will be appreciated by the person skilled in the art that various modifications may be made to the above described embodiments, without departing from the scope of the present invention.

For example, the container body may be made from materials other than glass, such as plastic threaded PET (Polyethylene terephthalate) or PP (Polypropene), or metal. The container body in the above example is substantially cylindrical, but other body shapes may be used.

The thread on the container body neck may comprise a series of discrete overlapping ridges, or a substantially continuous helical thread. A typical container body thread may comprise four to six complete or partial threads turns. Reducing the number of thread turns, for example, to three, reduces the torque required to overcome the frictional force between the closure lugs and the container body thread. This makes the container easier to open. Reducing the overall thread depth, the jar to cap clearance or increasing the thread angle towards the vertical, may also be used to produce a similar effect. An asymmetrical thread profile may be created using various angle combinations.

Any modification of the closure lugs or container body thread which reduces the torque required to overcome the frictional force between the lugs and thread also reduces the lug strength required and hence permits further "light-weighting" of the closure lugs.

The venting features provided on the container sealing surface may be protrusions, and may be raised substantially between 0.1 mm and 0.4 mm above the sealing surface. Such protrusions may vary in size and shape, for example, protrusions of between 0.2 mm and 0.4 mm may be used. Alternatively, the venting features may comprise discrete recesses, indents or grooves which form discontinuities in the sealing surface. These may also vary in size and shape. For example, recesses of substantially between 0.1 and 0.4 mm maximum depth may be used. Alternatively, recesses of between 0.2 mm and 0.4 mm may be used. It will be appreciated that where recesses, indents or grooves are used instead of protrusions, a corresponding protrusion will form on the layer of sealing compound when soft, rather than a recess. However, the container will be vented in the same way upon relative rotation of the closure and container body.

In general, a relatively small venting feature height/depth is desirable in order to aid sealing, while a relatively larger height/depth is desirable to accelerate venting and breaking of the seal. Therefore, the height or depth of the venting feature or features utilised may vary depending upon the overall container configuration. It will be further appreciated that only one venting feature is actually required to break the seal, and further examples, not shown here, may be provided with more or less than three venting features.

The closures 20, 220 described above have four lugs, however, a smaller or a greater number of lugs may be employed. The closure lugs may be "light-weighted" by various means, for example, the lugs may be manufactured from a relatively weak material, such as aluminium or lower temper steel, or the lugs may have a modified profile or shape i.e. the lug arcuate length may be reduced, or the amount of material that is drawn into the curled portion of the lug may be reduced.

The closure wall 26, 226 may be configured to deform outwardly when the lugs are subjected to radial forces. For example, a closure with a weakened wall and four lugs will flex towards a quartic shape (between a circle and a square) as it flexes past the lugs. A reduction in closure wall strength, or some elasticity, allows the closure to deform to increase its outer radius, so that the closure lugs jump over the container body thread without incurring permanent damage or becoming permanently deformed. The closure then snaps back to its original shape, whereupon the venting features have already operated to release the vacuum. Deformability of the closure wall may be achieved by use of a thinner material, or by other means, for example, by use of a substantially weaker material, by use of a tighter curl on the rim of the closure, or by increasing the overall depth of the closure. For example, a four-lugged 70 mm deep closure may be made from 0.17 material as opposed to the 0.19 high temper material that is necessary to give zero percent faults.

The container body and single-piece closure, as disclosed above, therefore serve to obviate the problems previously described. Since the container body is provided with venting features to break the vacuum seal, the closure lugs and container body thread are not required to play a role in lifting the closure panel to vent the container. As a result, "light-weighting" of the closure lugs, or weakening of the lug/thread interface, is possible, reducing manufacturing costs and minimising environmental impact. The "light-weighted" lugs produce less frictional force against the container body thread and sealing compound, thereby facilitating opening by reducing the torque required to open the container. "Light-weighted" lugs are also more elastic and therefore more able to jump the thread during a "spinning" event without suffering permanent deformation. The container body may be re-closed by screwing the closure back on, as required.

The combination of a vented, re-closable container and a low lug strength closure may be used for a variety of container body and closure sizes and materials. For example, the principle of using low lug strength and venting features for threaded jars is applicable to 110, 100, 89, 82, 77, 70, 66, 63, 58, 53, 48, 43, 38, 30 mm diameter lugged closures with regular and deep wall heights. The technology enables substantial down gauging, for example reducing steel thickness from 0.19 to 0.15 for a 70 mm diameter closure. It may be used in a variety of vacuum closure markets, for example, plastic threaded PET or PP jars with vacuum closures.

Only minimal changes are required to the manufacture of the container body and closure. No substantial changes to normal processes, such as filling, capping, packing and distributing, are required, and the outward aesthetic appearance of the product remains unchanged.

The invention claimed is:

1. A re-closable container comprising:

a container body, a single piece metal closure, and a layer of sealing compound provided on an underside of the closure, the container body and the closure having first cooperating features to allow the closure to be twisted onto and off of the container body, wherein the first cooperating features of the container body include a thread on a neck region, and the first cooperating features of the closure include metal lugs on an inner surface of the closure, the layer of sealing compound and a sealing surface of the container body which comes into in contact with the sealing compound having second cooperating features which establish one or more venting passages upon rotation of the closure from a closed position, wherein the second cooperating features comprise one or more protrusions or indents in the sealing surface and one or more corresponding indents or protrusions on the sealing compound that are radially aligned with the one or more protrusions or indents in the sealing surface when the closure is in a closed position.

2. A re-closable container as claimed in claim 1, wherein said lugs are configured to jump over the thread when the closure is twisted while the container body is venting.

3. A re-closable container as claimed in claim 2, wherein said lugs are sufficiently elastically deformable to facilitate said jumping.

4. A re-closable container as claimed in claim 1, wherein said second cooperating features comprise three or more protrusions on the sealing surface and associated indents in the sealing compound.

5. A re-closable container as claimed in claim 1, wherein said second cooperating features comprise three or more indents on the sealing surface and associated protrusions on the sealing compound.

6. A re-closable container as claimed in claim 1, wherein said sealing surface is an upper surface of a rim of the container.

7. A re-closable container as claimed in claim 1, wherein the thread has an asymmetric profile.

8. A re-closable container as claimed in claim 1, wherein said sealing compound is plastisol.

9. A re-closable container as claimed in claim 1, the container containing a product and a partial vacuum existing with a headspace of the product.

10. A method of combining a container body and a single piece closure to form the re-closable container of claim 1, the method comprising the steps of filling the container body with a hot product, applying a soft sealing compound to an underside of the closure, screwing the closure onto the container body, such that after the screwing step, the sealing compound hardens.

11. A re-closable container as claimed in claim 7, wherein the thread has an upper thread angle and a lower thread angle, wherein the upper thread angle is greater than the lower thread angle.

* * * * *